US006705494B2

(12) United States Patent
Thompson et al.

(10) Patent No.: US 6,705,494 B2
(45) **Date of Patent: *Mar. 16, 2004**

(54) HAND-HELD PRODUCT DISPENSERS HAVING PRESSURIZED DELIVERY

(75) Inventors: Harold Rand Thompson, Norwell, MA (US); Gordon Gerald Guay, Chelmsford, MA (US)

(73) Assignee: The Gillette Company, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/305,209

(22) Filed: Nov. 26, 2002

(65) Prior Publication Data

US 2003/0075571 A1 Apr. 24, 2003

Related U.S. Application Data

(63) Continuation of application No. 09/442,347, filed on Nov. 17, 1999, now Pat. No. 6,494,349.

(51) Int. Cl.[7] ..... B65D 83/00
(52) U.S. Cl. ..... 222/402.15; 222/310; 222/505
(58) Field of Search ..... 222/287, 310, 222/402.13, 402.15, 402.21, 402.25, 472, 505; 410/190

(56) References Cited

U.S. PATENT DOCUMENTS

| | | | | |
|---|---|---|---|---|
| 2,643,914 A | | 6/1953 | Reswick | |
| 2,746,797 A | | 5/1956 | Remane | |
| 2,879,925 A | | 3/1959 | Remane | |
| 2,995,308 A | | 8/1961 | Ashkenaz | 239/302 |
| 3,093,857 A | | 6/1963 | Hersh | |
| 3,109,656 A | | 11/1963 | Kutik | |
| 3,138,331 A | | 6/1964 | Kutik | |
| 3,174,659 A | * | 3/1965 | Sorber et al. | 222/402.2 |
| 3,189,232 A | | 6/1965 | Joffe | |
| 3,252,626 A | | 5/1966 | Belka | |
| 3,429,484 A | | 2/1969 | Baldwin | 222/402.13 |
| D218,145 S | | 7/1970 | Doblin | |
| 3,648,905 A | | 3/1972 | Kauder | 222/402.21 |
| D234,074 S | | 1/1975 | Nilsson | |
| 3,987,942 A | | 10/1976 | Morane et al. | 222/402.15 |
| 4,077,549 A | | 3/1978 | Beard | 222/321 |

(List continued on next page.)

FOREIGN PATENT DOCUMENTS

EP 07 285586 10/1995

OTHER PUBLICATIONS

International Search Report for PCT/US00/42019.

*Primary Examiner*—Joseph A. Kaufman
(74) *Attorney, Agent, or Firm*—Fish & Richardson P.C.

(57) ABSTRACT

A hand-held pressurized product dispenser that includes a container with a hand-engageable body portion, a valve mechanism at the top of the container that is movable with respect to the container to cause pressurized discharge of the product, and a valve actuation lever that is connected to the valve mechanism and extends along the container body such that a larger displacement of the end of the lever causes a controlled, relatively smaller displacement of the valve mechanism, permitting adjustable "throttled" delivery of the product. Also disclosed are: a product delivery member that is attached to the top of container and has a product holding structure that is positioned with respect to the valve mechanism to receive product and to hold the product in position for application; cam members are oriented to cause the valve actuating lever to move downward as it is moved toward the container body: and a movable stop member that is carried on the container and faces the hand-engageable portion so as to limit travel of the hand-engageable portion toward the container.

5 Claims, 9 Drawing Sheets

U.S. PATENT DOCUMENTS

| | | | | |
|---|---|---|---|---|
| 4,111,338 | A | | 9/1978 | Cheng et al. ..... 222/180 |
| 4,157,774 | A | | 6/1979 | Nicallef ..... 222/321 |
| 4,264,037 | A | | 4/1981 | Nozawa ..... 239/333 |
| 4,636,102 | A | | 1/1987 | Drake ..... 401/190 |
| 4,733,984 | A | | 3/1988 | Katsuda et al. ..... 401/190 |
| 4,826,054 | A | | 5/1989 | Frutin ..... 222/402.11 |
| 5,040,705 | A | | 8/1991 | Snell ..... 222/402.15 |
| 5,119,806 | A | | 6/1992 | Palson et al. ..... 128/200.14 |
| 5,147,075 | A | | 9/1992 | Regan ..... 222/402.15 |
| 5,186,364 | A | | 2/1993 | Laszlo ..... 222/153 |
| 5,348,189 | A | | 9/1994 | Cater ..... 222/341 |
| 5,489,048 | A | | 2/1996 | Stern et al. ..... 222/402.1 |
| 5,524,798 | A | | 6/1996 | Stern et al. ..... 222/402.1 |
| 5,571,246 | A | | 11/1996 | Alldredge ..... 128/200.23 |
| 5,645,198 | A | | 7/1997 | Stern et al. ..... 222/402.1 |
| 5,655,691 | A | | 8/1997 | Stern et al. ..... 222/402.1 |
| 5,678,730 | A | * | 10/1997 | Fabek et al. ..... 222/78 |
| 5,715,975 | A | | 2/1998 | Stern et al. ..... 222/402.1 |
| 5,921,446 | A | | 7/1999 | Stern ..... 222/402.1 |
| 5,937,874 | A | | 8/1999 | Guay et al. ..... 132/321 |
| 6,016,938 | A | | 1/2000 | Eichorst ..... 222/402.15 |
| 6,029,862 | A | | 2/2000 | Jones ..... 222/402.11 |
| 6,494,349 | B1 | * | 12/2002 | Thompson et al. .... 222/402.15 |

* cited by examiner

HAND-HELD PRODUCT DISPENSERS HAVING PRESSURIZED DELIVERY

This application is a continuation of U.S. application Ser. No. 09/442,347 filed Nov. 17, 1999, now U.S. Pat. No. 6,494,349.

BACKGROUND OF THE INVENTION

The invention relates to hand-held product dispensers having pressurized delivery.

Various products have been conveniently dispensed in a pressurized form from a hand-held container such as a spray can. Typically a push button on top of the can is depressed to actuate a valve that provides an open path from the material in the container to a spray nozzle on the push button that directs the pressurized material in a direction that is perpendicular to the push button direction. This push button type of mechanism is often used for antiperspirant, deodorant and shaving cream dispensers.

Alternatively, some valves are actuated by providing a tilt (sideways push) action to an elongated tubular nozzle that directs the product along the axis of the can. Such valves are often employed in whipped cream dispensers.

SUMMARY OF THE INVENTION

In one aspect, the invention features, in general, a hand-held pressurized product dispenser that includes a container with a hand-engageable body portion, a valve mechanism at the top of the container that is movable with respect to the container to cause pressurized discharge of the product, and a valve actuation lever that is connected to the valve mechanism and extends along the container body. With this arrangement, a larger displacement of the end of the lever causes a controlled, relatively smaller displacement of the valve mechanism, permitting adjustable, "throttled" delivery of the product.

In another aspect, the invention features, in general, a hand-held pressurized product dispenser that includes a container with a hand-engageable body portion, a valve mechanism at the top of the container, and a valve actuation lever that extends along the container body. The product dispenser also includes a product delivery member that is attached to the top of container and has a product holding structure that is positioned with respect to the valve mechanism to receive product and to hold the product in position for application.

Preferred embodiments of the invention may include one or more of the following features. The product holding structure can take a variety of forms to assist in applying product. For example, it can have a generally flat upper surface or an arcuate surface. The product holding structure can be a porous structure having pores that receive the product. The product holding structure can be an elastomeric applicator. The product holding structure can be a sintered structure. The product holding structure can have a textured surface. The product holding structure can have a grid surface.

In another aspect, the invention features, in general, a hand-held pressurized product dispenser that includes a container with a hand-engageable body portion, a valve mechanism at the top of the container, and a valve actuation member that has a hand-engageable portion that extends along the container body. The valve mechanism is movable away from the container to discharge the product, and the valve actuating member is connected to move the valve mechanism away from the container as the hand-engageable portion is moved toward the body portion of the container.

In another aspect, the invention features, in general, a hand-held pressurized product dispenser that includes a container with a hand-engageable body portion, a valve mechanism at the top of the container, and a valve actuation member that is made of plastic and has a hand-engageable portion that extends along the container body and is pivotally connected with respect to the container via a living hinge.

In another aspect, the invention features, in general, a hand-held pressurized product dispenser that includes a container with a hand-engageable body portion, a valve mechanism at the top of the container, and a valve actuation member that has a hand-engageable portion that extends along the container body. The valve actuation member has a pivot end that is pivotally connected with respect to the container and also has a valve engaging portion that engages the valve mechanism and is located between the pivot end and the hand-engageable portion. Alternatively the pivot can be located between the valve engaging portion and the hand-engageable portion.

In another aspect, the invention features, in general, a hand-held pressurized product dispenser that includes a container with a hand-engageable body portion, a valve mechanism at the top of the container, and a valve actuation member that has a hand-engageable portion that extends along the container body. The hand-engageable portion of the valve actuation member has a first cam member that faces the container, and the container carries a second cam member that faces the first cam member. The first and second cam members are oriented such that, as the hand-engageable portion is moved toward the container, interaction of the first and second cam surfaces causes the valve actuating member to move downward to actuate the valve mechanism.

In another aspect, the invention features, in general, a hand-held pressurized product dispenser that includes a container with a hand-engageable body portion, a valve mechanism at the top of the container, and a valve actuation member that has a hand-engageable portion that extends along the container body. The container carries a movable stop member that faces the hand-engageable portion so as to limit travel of the hand-engageable portion toward the container. The stop member has different portions that are selectively movable into position facing the hand-engageable portion so as to adjust movement of the valve actuating member.

The dispensers can be used to dispense various products such as a shaving aid, an antiperspirant, a deodorant, a body spray, after shave lotion, hair spray, a liquid, a semi-solid, a gel, a cream or a powder. The container can be an aerosol container, a container having a product bag inside a pressurized chamber, or another type of container providing pressurized delivery of product.

Embodiments of the invention may include one or more of the following advantages. The throttling permitted by the actuation lever allows the user to employ different types of sprays ranging from a fine mist to a hard spray. The side location of the actuation lever promotes accuracy in directing the product. The consumer has more control over product application and has the ability to personalize the application experience. The side location of the actuation lever also improves ergonomics. With the product holding structure on the container top, the user need not apply certain products to his or her hands prior to applying the products to the skin or hair.

Other advantages and features of the invention will be apparent from the following description of particular embodiments thereof and from the claims.

DESCRIPTION OF THE PREFERRED EMBODIMENTS

Figure 1:
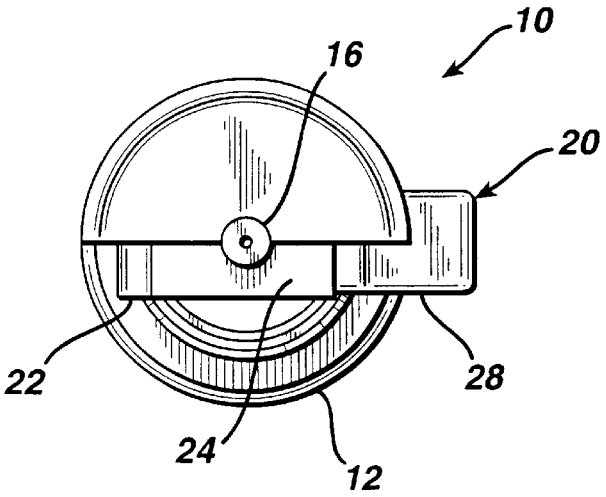
FIG. 1 is a plan view, with a cap component in section, of a product dispenser.
Figure 2:
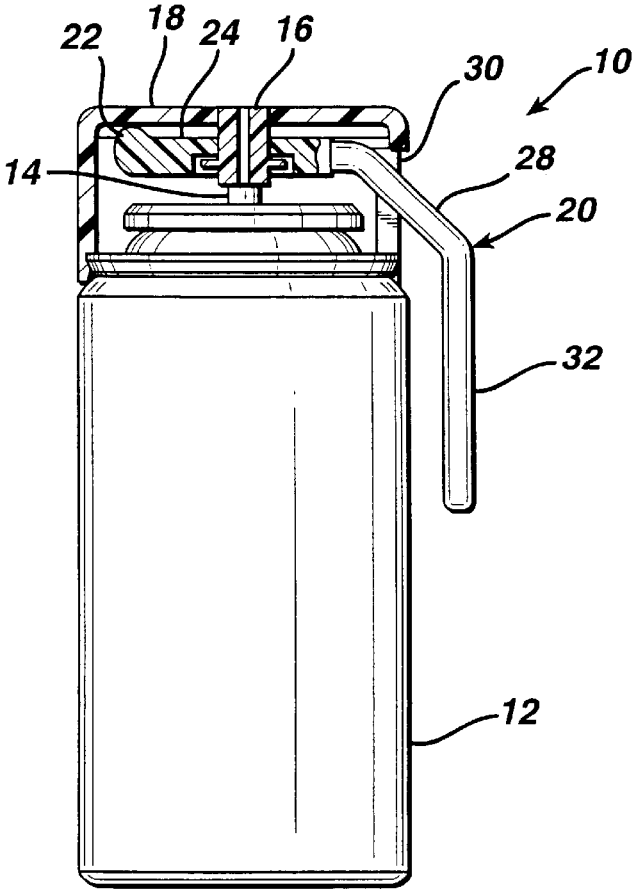
FIG. 2 is an elevation, with a cap component in section, of the FIG. 1 product dispenser.
Figure 3:
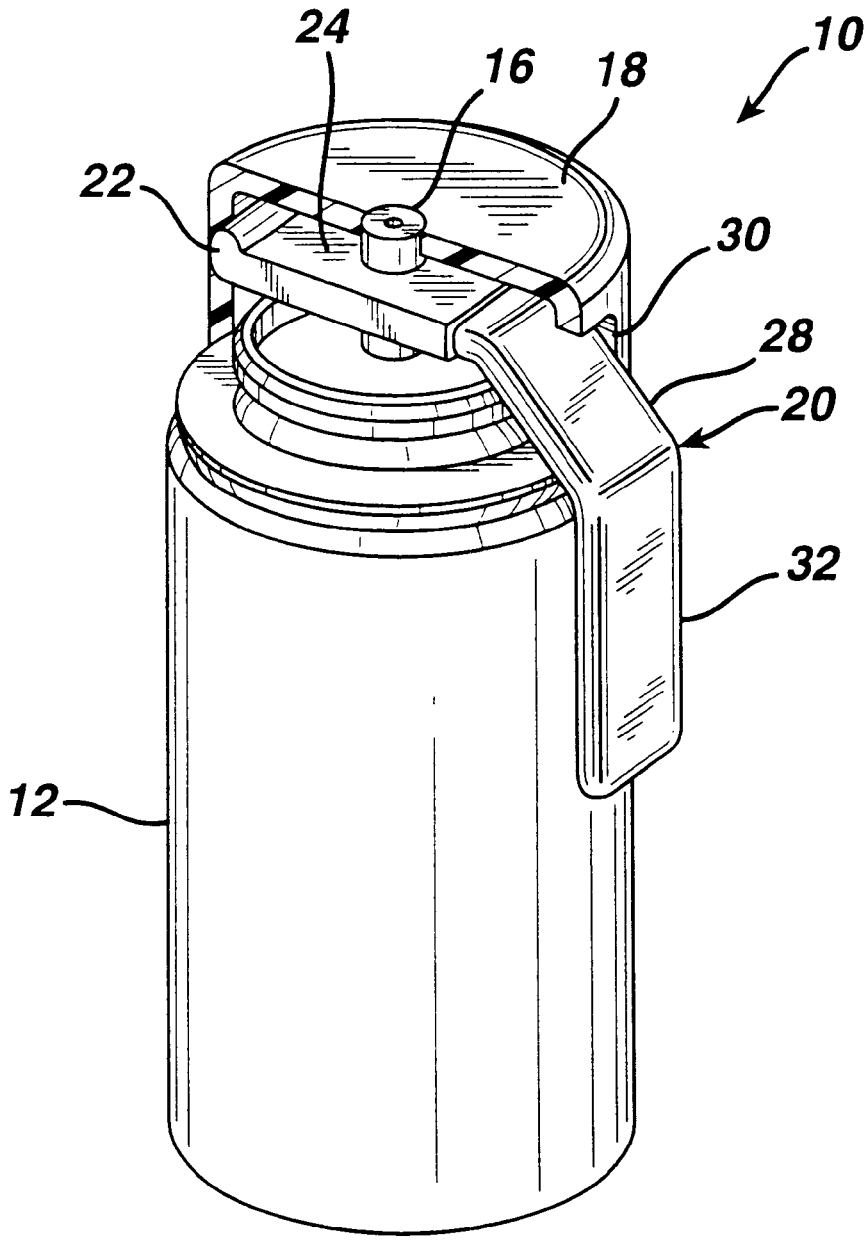
FIG. 3 is a perspective view, with a cap component in section, of the FIG. 1 product dispenser.

Referring to FIGS. 1–3, spray dispenser 10 includes aerosol container 12, having valve mechanism 14 of the type that is actuated by depression of nozzle 16, which directs the spray axially, unlike the typical finger-actuated push-button nozzle, which directs the spray radially. The majority of valve mechanism 14 is located inside container 12 at the top; a suitable valve mechanism, e.g., is the type used in commercial Right Guard antiperspirant dispensers. Dispenser 12 also includes a plastic cap 18, attached to the top of container 12, and valve actuation lever 20, which pivots at pivot end 22 underneath cap 18. Lever 20 includes upper portion 24, which extends along the interior upper surface of cap 18 and is connected to a lower portion of nozzle 16. Lever 20 also includes angled portion 28, which extends through opening 30 in cap 18, and hand-engaging portion 32, which extends along the body of container 12.

When using dispenser 10, the user holds the container in his or her hand, and squeezes hand-engaging portion 32 toward container 12, which results in a smaller downward depression of nozzle 16, owing to the longer moment arm at portion 32 than at nozzle 16. This permits the user to throttle and adjust the flow rate of the delivery of product from nozzle 16. The different types of sprays that can be employed range from a fine mist to a hard stream. The side location of actuation lever 20 improves ergonomics (reducing the extent of wrist deflection needed for actuation and use), and promotes accuracy in directing the product in addition to controlling the amount of product being dispensed. The consumer thus has more control over product application and has the ability to personalize the application experience. Dispenser 10 could also be used to dispense creams or gels under pressure, using either propellant or internal bladder technology (e.g., available from Sepro).

Figure 4:
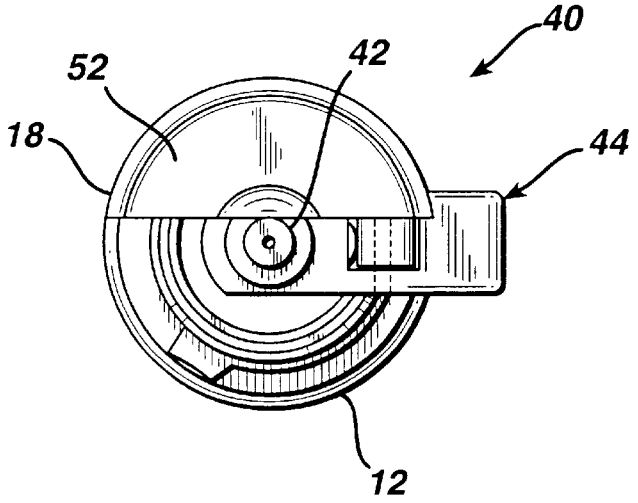
FIG. 4 is a plan view, with a cap component in section, of an alternative embodiment of a product dispenser.
Figure 5:
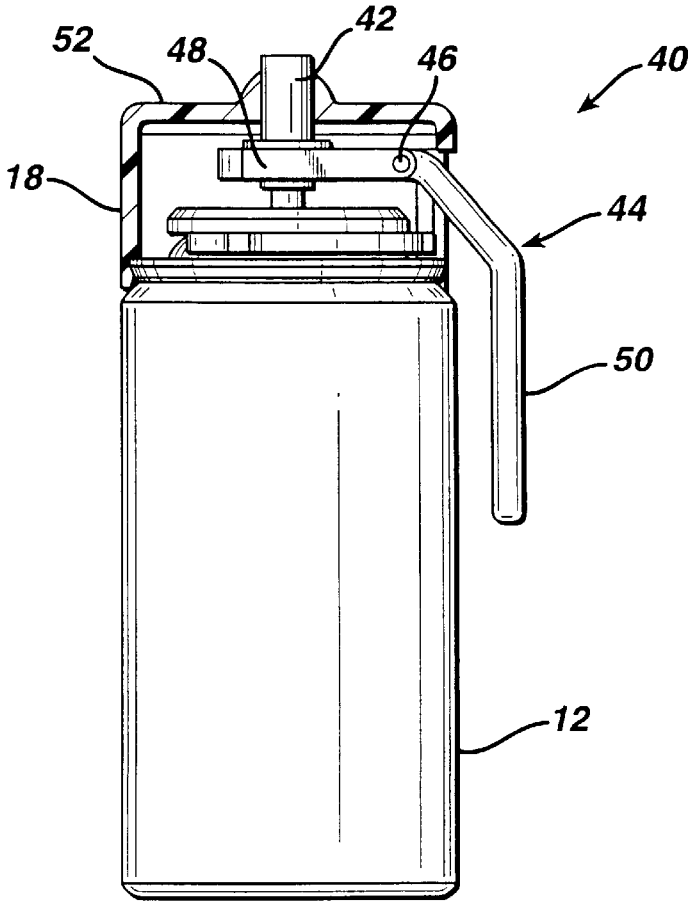
FIG. 5 is an elevation, with a cap component in section, of the FIG. 4 product dispenser.
Figure 6:
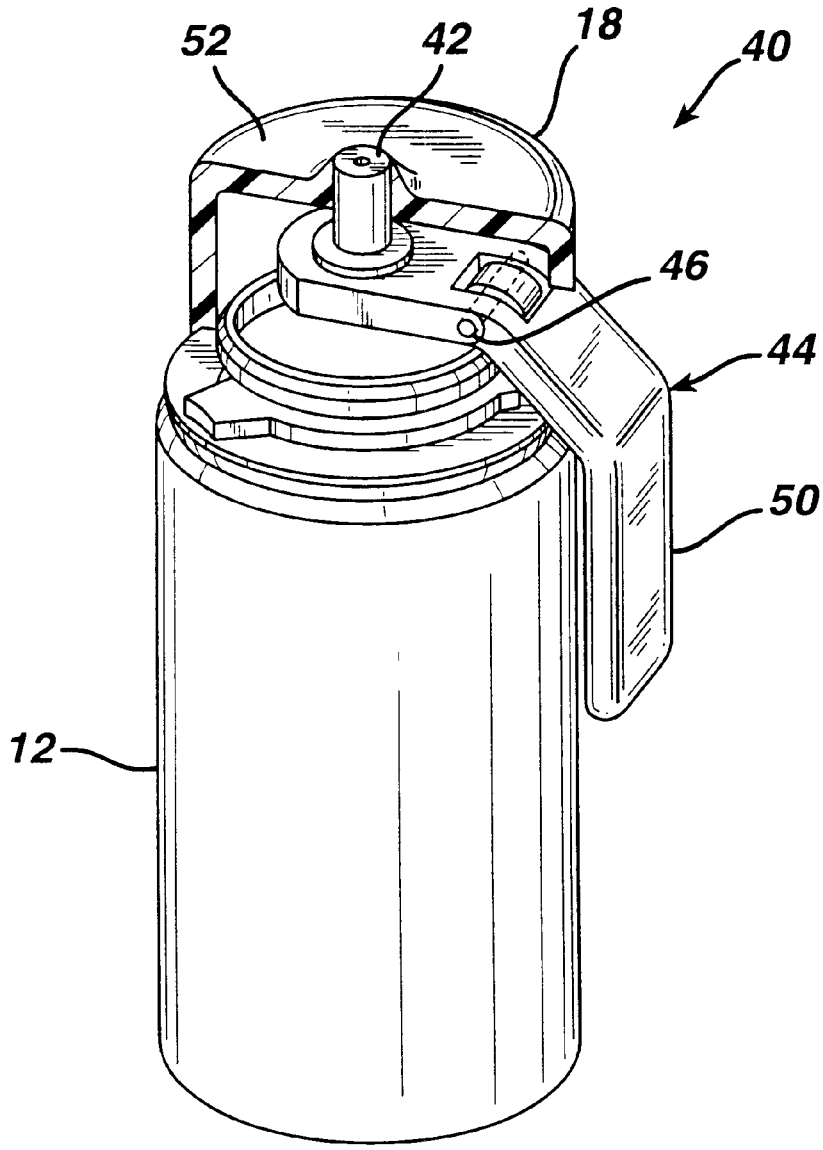
FIG. 6 is a perspective view, with a cap component in section, of the FIG. 4 product dispenser.

Referring to FIGS. 4–6, dispenser 40 is similar to dispenser 10 in that it includes container 12, cap 18, axially directed nozzle 42 and side actuation lever 44. Dispenser 40 differs from dispenser 10 in that nozzle 42 is actuated by extending it from container 12 (instead of depressing), and the pivot 46 for lever 44 is located between the end 48 connected to nozzle 42 and the hand-engaging portion 50, which extends along the body of container 12. With this arrangement, the product is dispensed with nozzle 16 extended above the upper surface 52 of cap 18. The dispensed product can be collected on surface 52, and nozzle 16 can then be retracted during application of the product, e.g., to a user's skin.

Figure 7:
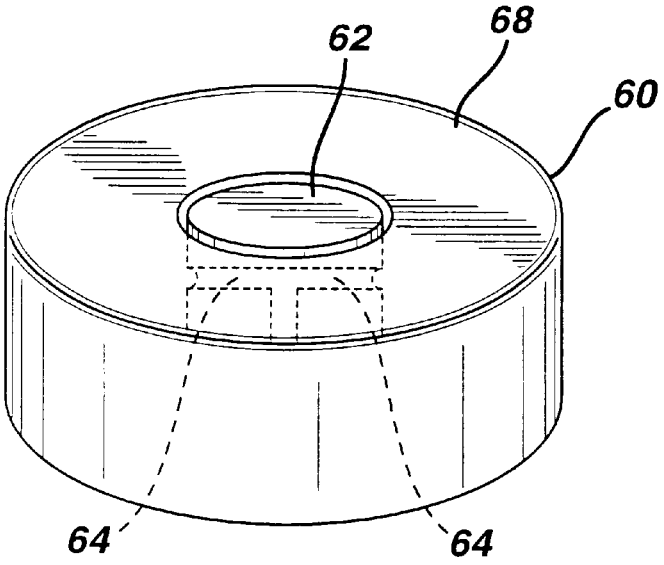
FIG. 7 is a perspective view of modified cap and nozzle components of the FIG. 4 product dispenser with the nozzle in a retracted position.
Figure 8:
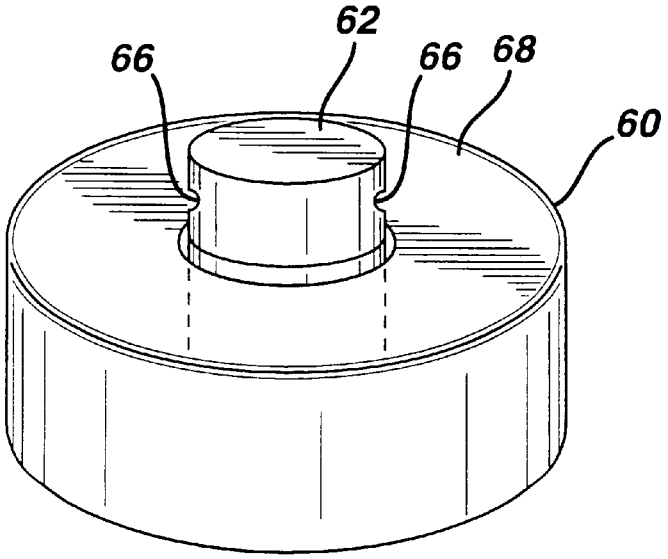
FIG. 8 is a perspective view of the FIG. 7 cap and nozzle components with the nozzle in an extended position.

Referring to FIGS. 7–8, modified cap 60 and nozzle 62 are shown. Nozzle 62 is in a retracted position in FIG. 7 and is in an extended, dispensing position in FIG. 8. Nozzle 62 has internal passageways 64 that direct the product to side openings 66, where the product is dispensed laterally, to the upper surface 68 of cap 60 in the extended position shown in FIG. 8. Cap 60 and nozzle 62 are desirably used on container 40 of FIGS. 4–6. The product is collected on the upper cap surface 68 prior to application to a user's skin. Thus a shaver can dispense and apply shaving cream without the need to put foam on his or her hands and without the need to rinse off the hands after applying the cream and prior to shaving. In addition, surface 68 can be provided with functional surfaces to provide efficacy, comfort or a combination of benefits. Surface 68 can be provided with a textured applicator. Surface 68 could be provided with flocked foam surface (e.g., available from TekPak in NJ and Claremont Flock Inc. of Claremont, N.H.). Alternatively, porous sintered domes, of the type employed in Narta deodorant cans, can also be used. Surface 68 can be flat, as shown, or arcuate. It could also be provided with a grid structure or elastomeric applicator.

Figure 9:
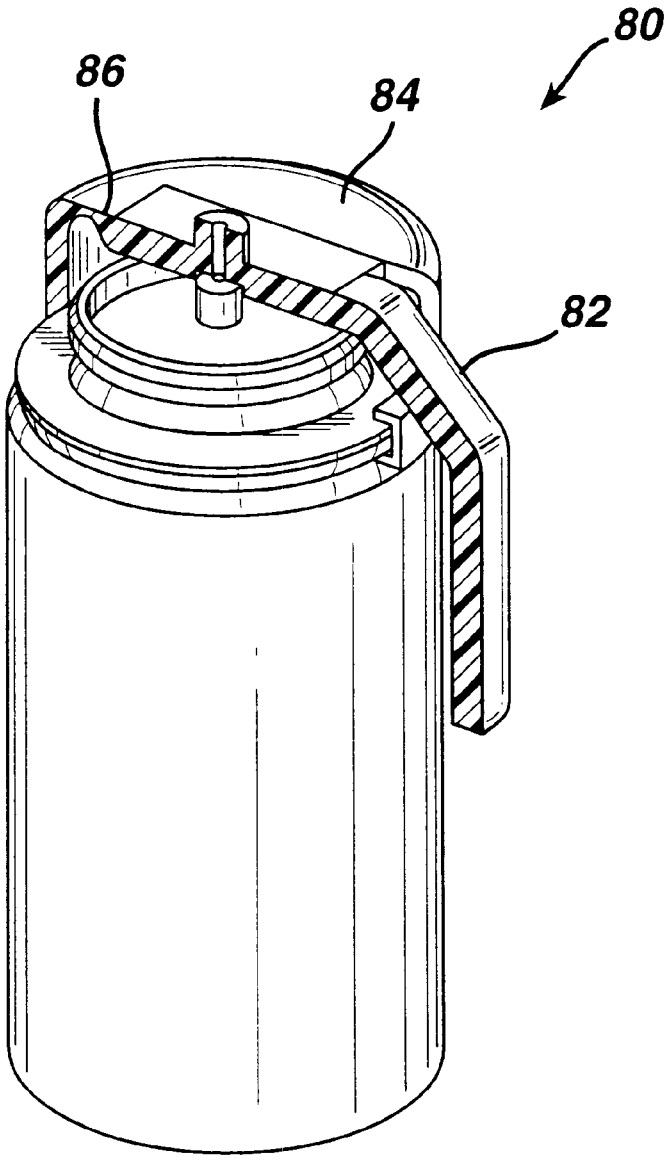
FIG. 9 is a perspective view, with a cap component in section, of a further alternative embodiment of a product dispenser.

Referring to FIG. 9, dispenser 80 is similar to dispenser 10, except that plastic lever 82 is integral with plastic cap 84. The upper end of lever 82 is pivotally connected to cap 84 at living hinge 86.

Figure 10:
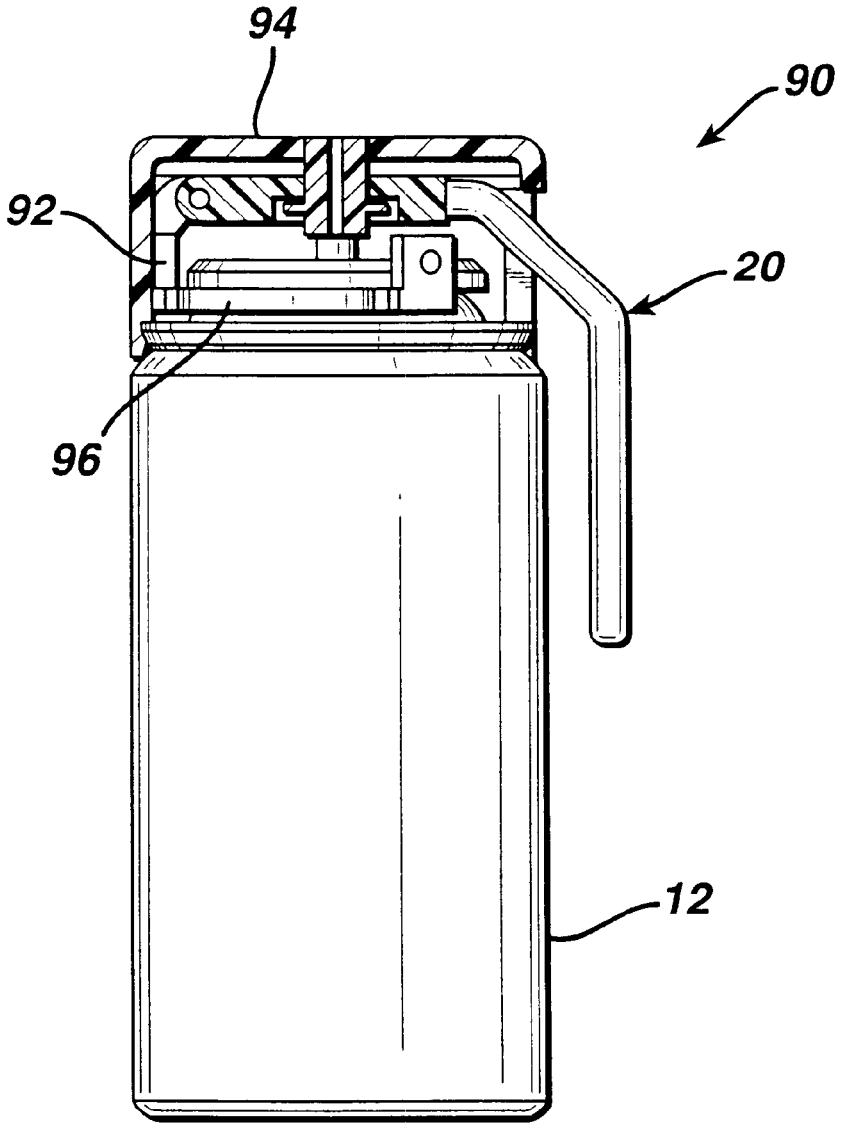
FIG. 10 is an elevation, with a cap component in section, of a further alternative embodiment of a product dispenser.

Referring to FIG. 10, dispenser 90 is similar to dispenser 10, except that it has the upper end of lever 20 pivotally connected to vertical support 92 instead of cap 94. Support 92 is attached to an upstanding circular structure on container 12 by ring 96. With dispenser 90, product can be dispensed with cap 94 on or with cap 94 off.

Figure 11:
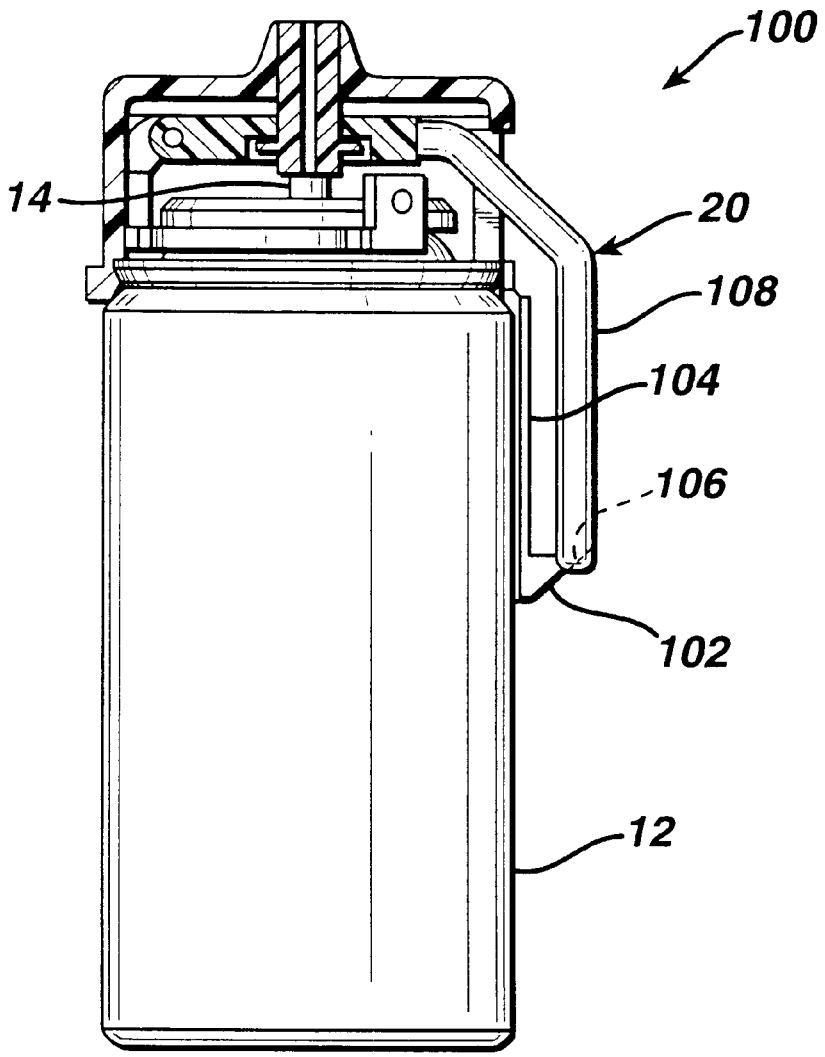
FIG. 11 is an elevation, with a cap component in section, of a further alternative embodiment of a product dispenser.

Referring to FIG. 11, dispenser 100 is similar to dispenser 90, except that it employs cam surface 102, on member 104 on container 12, and mating cam surface 106 on the inner side of hand-engaging lever portion 108 facing container 12. As hand-engaging portion 108 is squeezed toward container 12, surface 106 tends to slide downward (as well as inward) along surface 102, exerting a downward force in the lever 20 that assists in depressing valve 14 without requiring large angular movement of lever 20.

Figure 12:
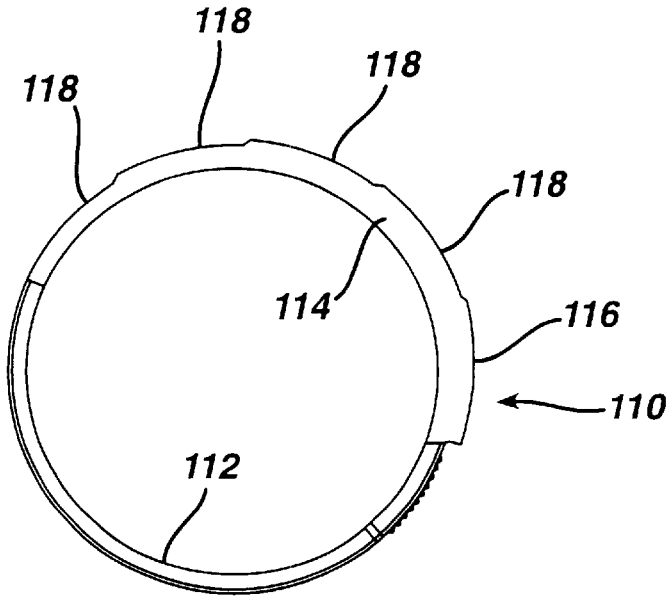
FIG. 12 is a plan view of an adjustable-stop ring component useful with the FIG. 11 dispenser.
Figure 13:
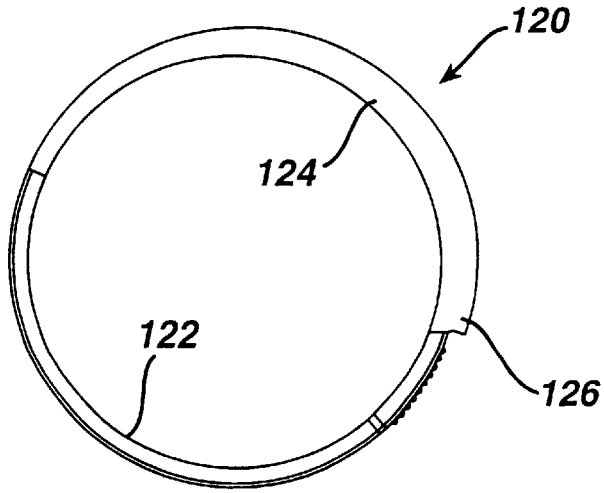
FIG. 13 is a plan view of an alternative embodiment of an adjustable-stop ring component useful with the FIG. 11 dispenser.

Referring to FIGS. 12 and 13, metering rings 110 and 120 are shown. Both rings 110, 120 are mounted on a respective container 12 aligned with, and inside of, a respective hand-engageable portion 108 of dispenser 100 shown in FIG. 11. Each ring 110, 120 has in internal portion 112, 122, respectively, which is fixedly secured on can 12, and an outer adjustable stop portion 114, 124, respectively, that can slide around fixed internal portion 112, 122, such that different areas can be aligned with the lever. On ring 110, stop portion 116 has the largest radius and acts as a lock, preventing any movement of lever 108. Stop portions 118 have different radii and permit different amounts of flow. On ring 120, the end 126 of stop portion 124 acts as a lock, while the remainder of stop portion 124 has a gradually decreasing radius, permitting selection of any stop position desired for movement of the hand-engageable portion 108.

With the large moment arms provided by the side levers, stronger springs can be employed in the valves. Stronger springs can enhance the throttle mechanism and have the added benefit of reducing propellant leakage owing to salt build-up around the valve's rubber gasket.

Other embodiments of the invention are within the scope of the appended claims.

Besides valves that are actuated by downward depression, valves with tilt actuation (e.g., as available from Summit Technologies, Manchester, N.H. under designation AX-11209 0.019 RT) can be used. In this case, the caps have oval or other shape openings that permit tilting of the nozzle.

What is claimed is:

1. A hand-held pressurized product dispenser comprising a container containing product under pressure, said container having a top, a hand engageable body portion and a bottom, a valve mechanism at the top of said container that communicates with said container and is movable by depression toward or extension from said container to cause pressurized axial discharge of said product out of said container via a nozzle outlet that is located on said valve mechanism and axially aligned with said container, and a valve actuation lever that is pivotally connected to said valve mechanism via said nozzle and extends along said body to a lever end such that relatively larger displacement of said lever end causes a controlled, relatively smaller displacement of said valve mechanism, permitting adjustable throttled delivery of said product by the extent of angular displacement of said lever, wherein said lever is connected with respect to said valve mechanism so that movement of said lever has a fixed relationship with respect to movement of said valve mechanism.

2. The dispenser of claim 1 wherein said valve mechanism is movable by depression toward said container to cause said pressurized axial discharge.

3. The dispenser of claim 1 wherein said valve actuation lever has a pivot end that is pivotally connected with respect to said container and also having a valve engaging portion that engages said valve mechanism and is located between said pivot end and said hand-engageable portion.

4. A hand-held pressurized product dispenser comprising a container containing product under pressure, said container having a top, a hand engageable body portion and a bottom, a valve mechanism at the top of said container that communicates with said container and is movable by depression toward or extension from said container to cause pressurized axial discharge of said product out of said container via a nozzle outlet that is located on said valve mechanism and axially aligned with said container, and a valve actuation lever that is pivotally connected to said valve mechanism via said nozzle and extends along said body to a lever end such that relatively larger displacement of said lever end causes a controlled, relatively smaller displacement of said valve mechanism, permitting adjustable throttled delivery of said product, wherein said valve actuation lever has a valve engaging portion that engages said valve mechanism and a pivot that pivotally connects said valve actuating member with respect to said container and is located between said valve engaging portion and said hand-engageable portion.

5. A hand-held pressurized product dispenser comprising container containing product under pressure, said container having a top, a hand engageable body portion and a bottom, a valve mechanism at the top of said container that communicates with said container and is movable by depression toward or extension from said container to cause pressurized axial discharge of said product out of said container via a nozzle outlet that is located on said valve mechanism and axially aligned with said container, and a valve actuation lever that is pivotally connected to said valve mechanism via said nozzle and extends along said body to a lever end such that relatively larger displacement of said lever end causes a controlled, relatively smaller displacement of said valve mechanism, permitting adjustable throttled delivery of said product, wherein said valve mechanism is movable by extension from said container to cause said pressurized axial discharge.

* * * * *

UNITED STATES PATENT AND TRADEMARK OFFICE

CERTIFICATE OF CORRECTION

PATENT NO. : 6,705,494 B2 
DATED : March 16, 2004
INVENTOR(S) : Harold Rand Thompson and Gordon G. Guay It is certified that error appears in the above-identified patent and that said Letters Patent is hereby corrected as shown below:

Title page,
Item [56], References Cited, U.S. PATENT DOCUMENTS,
-- 2,897,526 8/1959 Dootson -- should be added.
"3,109,656" should be -- 3,109,565 --.
-- 4,089,609 5/1978 Gring et al. -- should be added.
-- 4,186,855 2/1980 Edman et al. -- should be added.

Column 1,
Line 4, "application" should be -- Application --.

Column 4,
Line 66, "in" should be -- an --.

Column 6,
Line 5, insert -- a -- before "container".

Signed and Sealed this

Fifteenth Day of March, 2005

JON W. DUDAS
*Director of the United States Patent and Trademark Office*